US005478223A

United States Patent [19]

Yamamoto et al.

[11] Patent Number: 5,478,223

[45] Date of Patent: Dec. 26, 1995

[54] SCROLL TYPE COMPRESSOR HAVING REACTION FORCE TRANSMISSION AND ROTATION PREVENTION FOR THE MOVEABLE SCROLL

[75] Inventors: Shinya Yamamoto; Masao Iguchi; Izuru Shimizu; Tetsuo Yoshida; Hisao Kobayashi; Shinichi Sato; Yoshitami Kondo; Kazuo Kobayashi, all of Kariya, Japan

[73] Assignee: Kabushiki Kaisha Toyoda Jidoshokki Seisakusho, Kariya, Japan

[21] Appl. No.: 128,827

[22] Filed: Sep. 29, 1993

[30] Foreign Application Priority Data

Sep. 30, 1992 [JP] Japan ..... 4-262370

[51] Int. Cl.[6] ..... F04C 18/04; F04C 29/02

[52] U.S. Cl. ..... 418/55.3; 418/55.6; 464/102

[58] Field of Search ..... 418/55.3, 55.6; 464/102

[56] References Cited

U.S. PATENT DOCUMENTS

| | | | |
|---|---|---|---|
| 4,406,600 | 9/1983 | Terauchi et al. | 418/55.13 |
| 4,552,517 | 11/1985 | Shimizu | 418/57 |
| 4,589,828 | 5/1986 | Sato et al. | 418/55.3 |

FOREIGN PATENT DOCUMENTS

| | | | |
|---|---|---|---|
| 60-159389 | 8/1985 | Japan | 418/55.3 |
| 63-219888 | 9/1988 | Japan | 418/55.6 |
| 1178784 | 7/1989 | Japan | 418/55.3 |
| 2291490 | 12/1990 | Japan | 418/55.3 |
| 3202689 | 9/1991 | Japan | 418/55.3 |

*Primary Examiner*—John J. Vrablik

*Attorney, Agent, or Firm*—Brooks Haidt Haffner & Delahunty

[57] ABSTRACT

An improved scroll type compressor is disclosed. A moveable scroll is eccentrically connected to a rotary shaft and opposed to a fixed scroll for forming a compression chamber. The moveable scroll performs an orbital movement about an axis of the rotary shaft without rotating about its own axis. With the orbital movement, the moveable scroll reduces the volume of the compression chamber and compresses coolant gas therein. A fixed wall is disposed adjacent to the moveable scroll on the opposite side from the fixed scroll. The fixed wall receives a reaction force of the compressed gas applied to the moveable scroll. First elements disposed between the fixed wall and the moveable scroll transmit the reaction force from the moveable scroll to the fixed wall. Second elements are disposed independently from the first elements between the fixed wall and the moveable scroll for determining the orbit of the moveable scroll.

2 Claims, 12 Drawing Sheets

SCROLL TYPE COMPRESSOR HAVING REACTION FORCE TRANSMISSION AND ROTATION PREVENTION FOR THE MOVEABLE SCROLL

BACKGROUND OF THE INVENTION

1. Field of the Invention

The present invention relates generally to a scroll type compressor. More specifically, the present invention relates to a scroll type compressor which includes an improved mechanism for transmitting reaction force applied from an orbiting scroll to the compressor housing.

2. Description of the Related Art

Conventional scroll type compressors generally include a standard structure having a two offset scroll members. Both scroll members have spiroidal or involute spiral members attached to a circular end plate. The spiroidal members are interfit and nestled with each other so that as a rotary shaft rotates one member around the other fixed member, a gas chamber is formed by the interfitting spiroidal members. During the course of the orbiting scroll's rotation, the volume and location of the gas chamber is defined by the interfitting scroll members, with the volume of gas decreasing as the rotation progresses. Gas is compressed in this manner when a constant volume of gas within the gas chamber decreases in size according to the progression of the rotating spiral member. According to the general construction of scroll type compressors, the orbiting scroll exhibits a tendency to rotate around its axis due to the rotation of the rotary shaft. It is necessary, however, to prevent the scroll from rotating around it's own axis and to keep it either horizontally or vertically in order to optimize the compressor's operation.

Japanese Examined Patent Publication No. 2-2476 discloses a compressor which includes an anti-rotation mechanism as described above. In this technology, as shown in FIG. 16, an orbiting scroll 102, interfit with a fixed scroll 100 in housing H, receives a reaction force of a compressed gas in compression chambers 106 due to the rotational force of a rotary shaft 104. The rear surface of a base plate 108 of the scroll 102 abuts against a pressure receiving wall 112, via the anti-rotation mechanism 110.

The mechanism 110 includes a movable ring 118 and a fixed ring 120 which are disposed between the base plate 108 and the wall 112, via races 114, 116, respectively (see FIG. 16). The movable ring 118 moves integrally with the scroll 102 and has a plurality of pockets 122 and 124, spaced within the circumferences of the rings 118, 120, at predetermined intervals, respectively. Rod shaped rollers 126 are horizontally supported between the associated pockets 122, 124 which are offset and facing each other.

In reaction to the rotation of rotary shaft 104, scroll member 102 and ring 118 rotate, and rollers 126 roll in the region of associate pockets 122, 124. Accordingly, the orbiting scroll 102 performs the orbital movement without itself rotating.

The diameter D of the pockets 122, 124 can be defined by the following formula:

$$D=d+r$$

where d is the diameter of the roller 126, and r is the radius of the orbiting scroll 102. Therefore, the diameter of the rollers 126 and the radius r of the orbiting scroll determine and control the diameter of the pockets 122 and 124.

End surfaces of the rollers 126 are slidably contacted with the races 114 and 116. The compression reaction force applied to the orbiting scroll is transmitted to wall 112, via the rollers 126. To improve upon the rigidity of the compressor, either the diameter or the actual numbers of rollers 126 should be increased. The enlarged pockets require the orbiting ring 118 and the fixed ring 120 to be wider. However widening the rings 118, 120 causes an increase of the overall sizing of the compressor and such a large compressor is not desirable for mounting in a vehicle.

To increase the ability for transmitting the compression reaction force without increasing the size of the compressor, it is necessary to increase the number of the rollers 126. However, the increase of the number of the rollers 126 increases the number of the pockets 122, 124. The increase of the number of the pockets 122, 124 which require a high precision process leads to longer processing time and higher manufacturing cost.

SUMMARY OF THE INVENTION

Accordingly, it is a primary object of the present invention to provide a scroll type compressor which requires a simplified manufacturing process and low manufacturing cost.

It is another object of the present invention to provide scroll type compressor requiring a small number of parts for simplifying the structure.

To achieve the foregoing and other objects and in accordance with the purpose of the present invention, an improved scroll type compressor is provided. The improved compressor has a moveable scroll eccentrically connected to a rotary shaft, and opposed to a fixed scroll for forming a compression chamber, said moveable scroll being arranged to perform an orbital movement about an axis of the rotary shaft without rotating about its own axis for reducing the volume of the compression chamber and compressing gas. The compressor further includes a fixed wall adjacent to the moveable scroll opposing the fixed scroll for receiving the reaction force of the compressed gas applied to the moveable scroll, a device for transmitting the reaction force from the moveable scroll to the fixed wall and a device for determining the orbit of the moveable scroll. This orbit determining device functions independently from the reaction force transmitting device.

BRIEF DESCRIPTION OF THE DRAWINGS

The features of the present invention that are believed to be novel set forth with particularity in the appended claims. The invention, together with objects and advantages thereof, may best be understood by reference to the following description of the preferred embodiments together with the accompanying drawings, in which:

DETAILED DESCRIPTION OF THE PREFERRED EMBODIMENTS

First Embodiment

The first embodiment of the present invention will now be described in greater detail, with reference to FIGS. 1 through 4.

Figure 1:
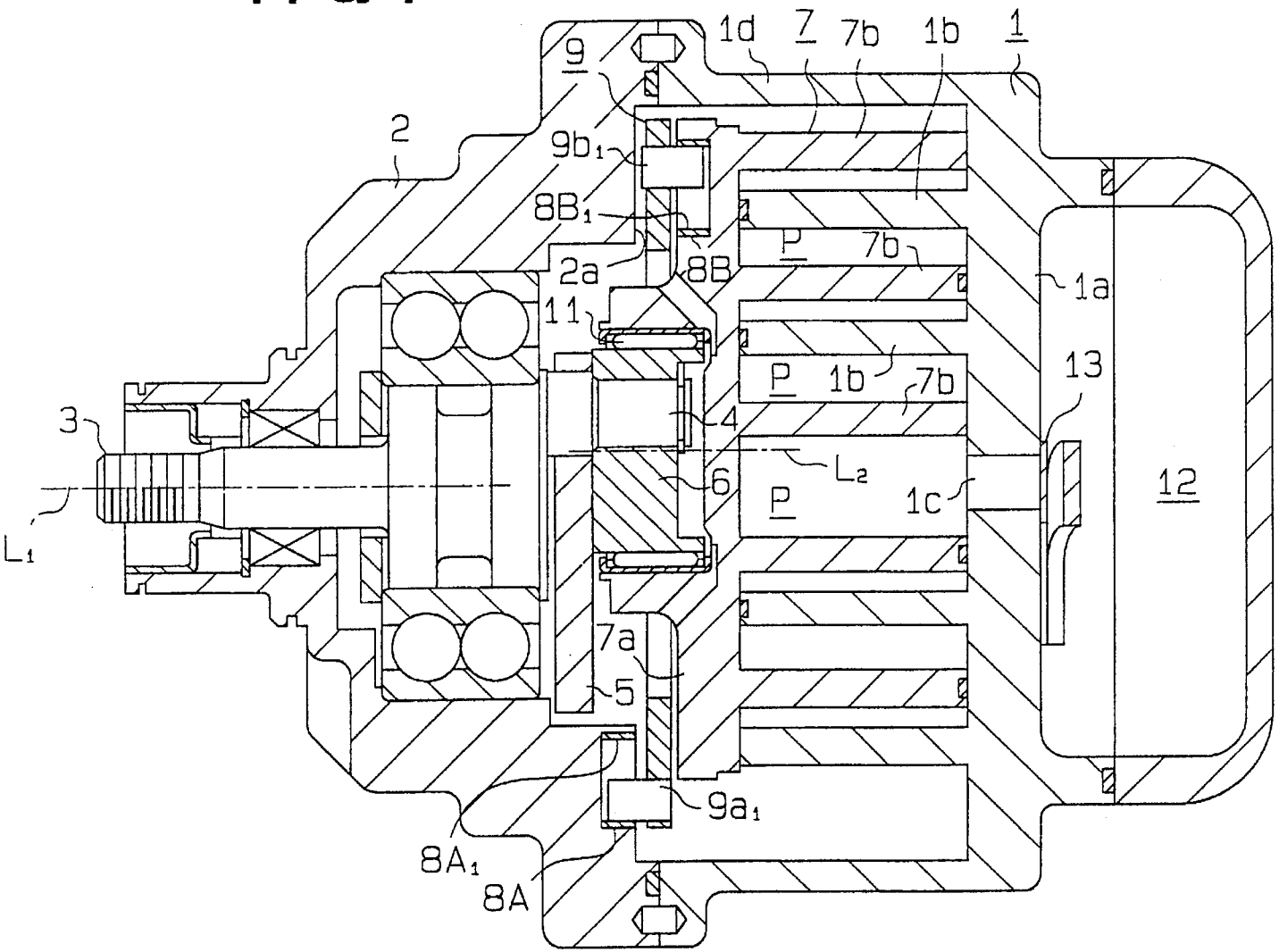
FIG. 1 is a longitudinal sectional view showing a scroll type compressor according to a first embodiment of the present invention.

As shown in FIG. 1, a front housing 2 is secured to a fixed scroll 1. A rotary shaft 3 is rotatably supported in the front housing 2, and an eccentric shaft 4 is secured to the rotary shaft 3.

A balancing weight J and a bushing 6 are orbitally supported by the eccentric shaft 4. An orbiting scroll 7 rotatably supported by the bushing 6, via a radial bearing 11, faces the fixed scroll 1. A compression chamber P is defined by scroll base plates 1*a*, 7*a* of the scrolls 1, 7 and spiral walls 1*b*, 7*b*. As the orbiting scroll 7 moves along a predetermined orbit, the compression chamber P decreases its capacity in order to compress a refrigerant gas in each compression chamber P.

A pair of cylindrical collars 8A (one of which is seen in FIG. 1) are secured to a pressure receiving wall 2*a* of the front housing 2, and holes $8A_1$, $8A_2$ are formed thereby for restricting the movement of the orbiting scroll 7, the collars being located facing the front portion of the base plate 7*a*. A pair of cylindrical Collars 8B (one of which as seen in FIG. 1) are secured to the base plate 7*a*, providing holes $8B_1$, $8B_2$, respectively, for restricting the movement of the orbiting scroll 7. The holes $8A_1$, $8A_2$ of the callers 8A are diametrically opposed to each other with respect to the rotational axis $L_1$ of the rotary shaft 3. The holes $8B_1$, $8B_2$ of the scroll 7 are also diametrically opposed to each other with respect to the center axis $L_2$ of the bushing 6.

A ring 9 is interposed between the base plate 7*a* and the wall 2*a*. The ring 9 has four pins $9a_1$, $9a_2$, $9b_1$, $9b_2$ securely spaced along its circumference. The pans are inserted into the holes $8A_1$, $8A_2$, $8B_1$, $8B_2$ for preventing the orbiting scroll 7 from rotating about its own axis. Among these pins, the pair of pins $9a_1$, $9a_2$ are diametrically opposed to one another with respect to the center of the ring 9. The other pair of pins $9b_1$, $9b_2$ are diametrically opposed to one another with respect to the center of the ring 9. A plurality of through holes 9*c* (eight holes in the first embodiment) having a larger diameter than those of the pins $9a_1$, $9a_2$, $9b_1$, $9b_2$ are spaced along the circumference of the ring 9.

Figure 2:
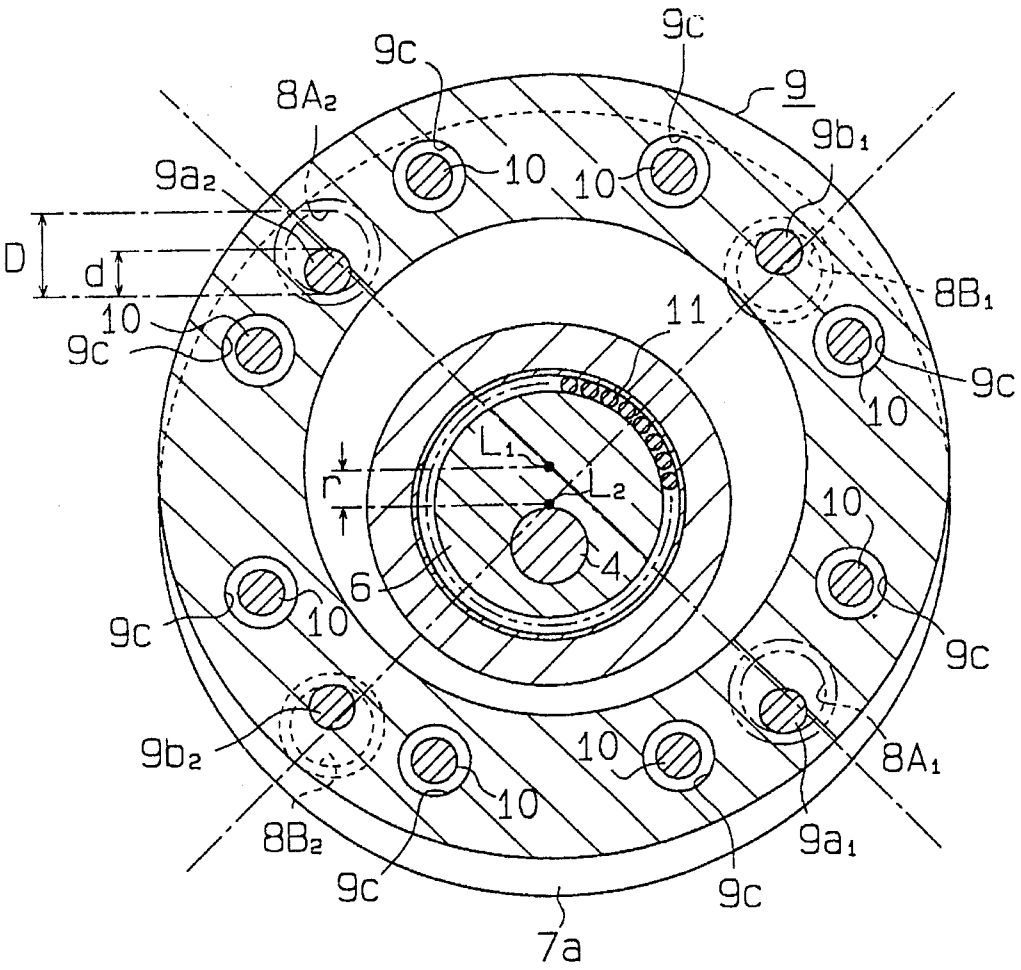
FIG. 2 is a cross sectional view showing the compressor taken along a line passing through the 9 in FIG. 1.
Figure 3:
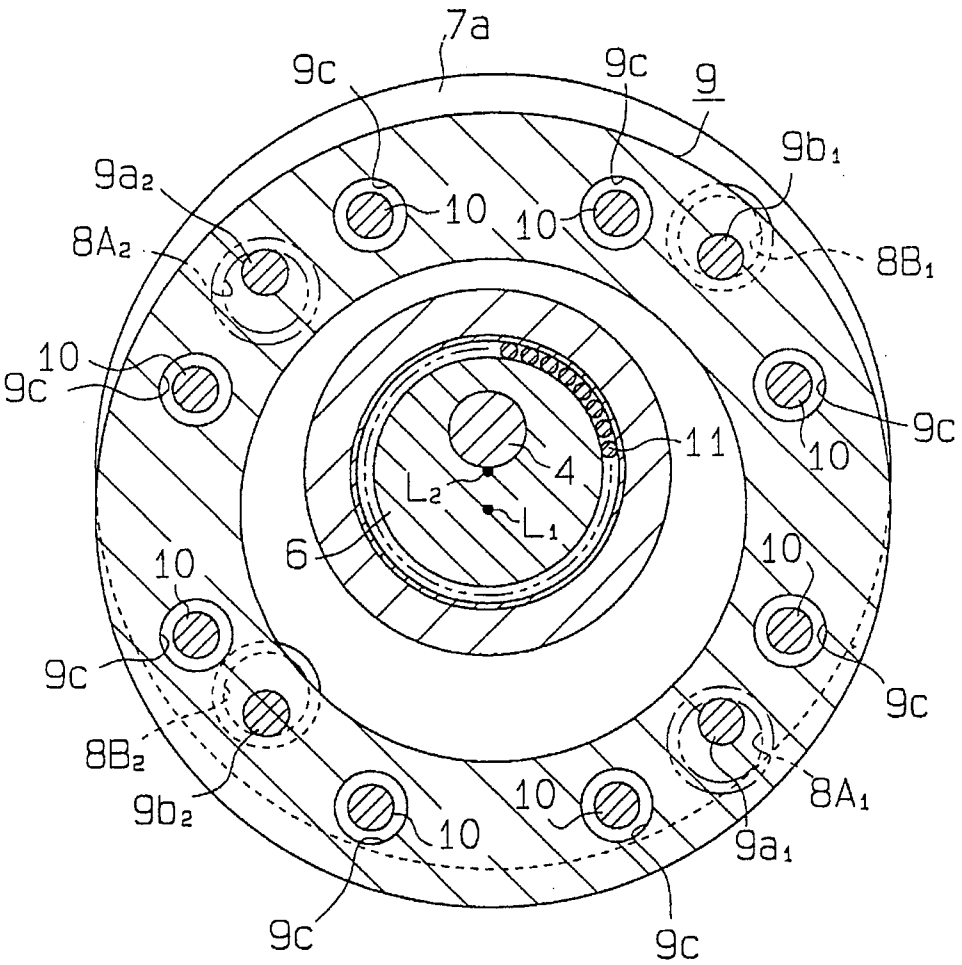
FIG. 3 is a cross sectional view showing the compressor in which the orbiting scroll is shifted by 180 degrees from the position shown in FIG. 2.
Figure 4:
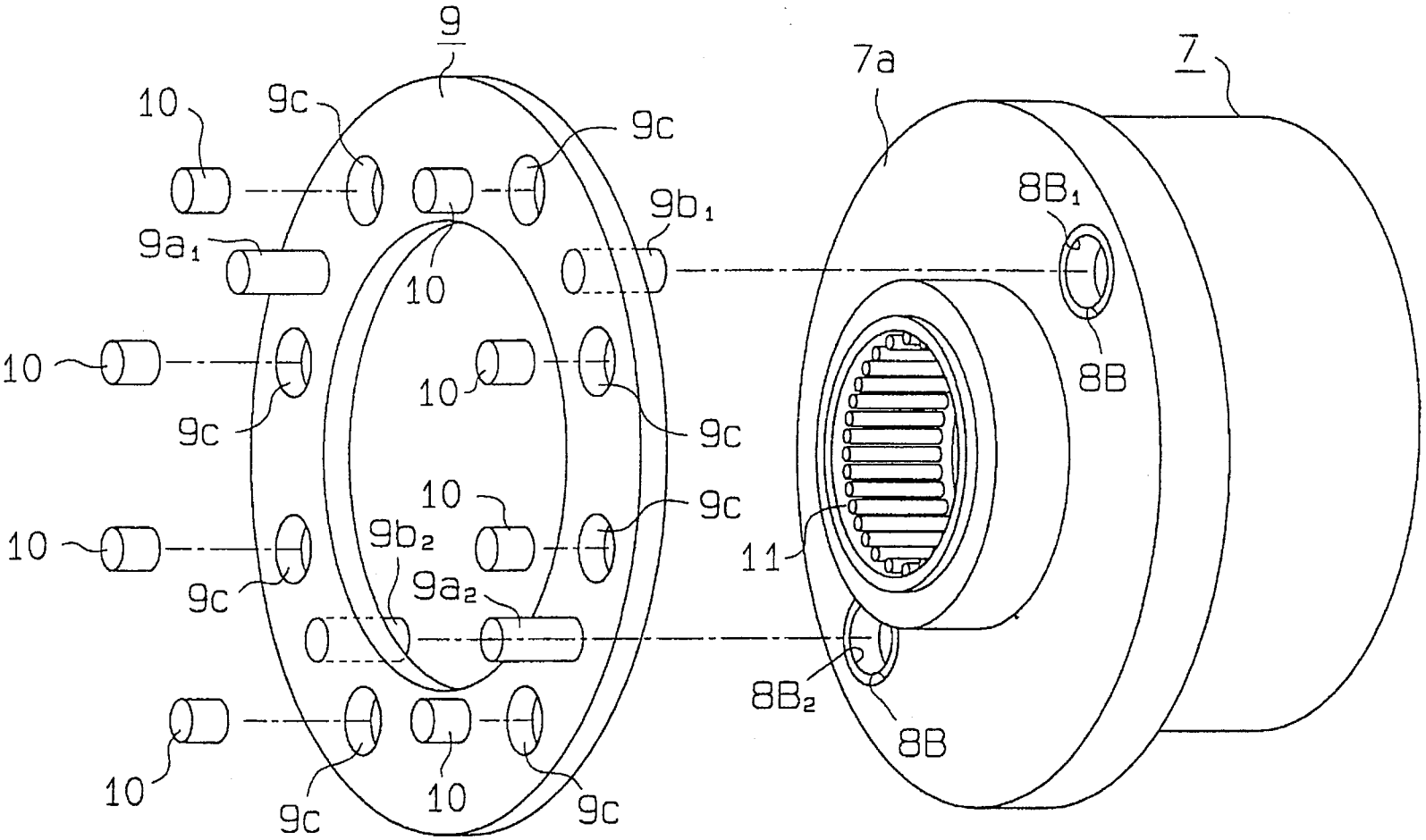
FIG. 4 is an exploded view in perspective showing the ring and orbiting scroll in FIG. 1.

As shorn in FIG. 2, the holes 8A, $8A_2$, 8B and $8B_2$ have a diameter D larger than the diameter d of the pin $9a_1$, $9a_2$, $9b_1$, $9b_2$. In this embodiment, D is set at 2*d*. FIG. 4 is a disassembled perspective view of the orbiting scroll 7 and ring 9. As shown in FIGS. 2 and 3, the pane $9a_1$, $9a_2$ are loosely inserted into the holes $8A_1$, $8A_2$ of the wall 2*a*. Likewise, the pins $9b_1$, $9b_1$ are loosely inserted into the holes $8B_1$, $8B_2$. Pin shaped pressure receiving elements 10 are inserted into the through holes 9*c*. The elements 10 are interposed between the base plate 7*a* and the wall 2*a* for transmitting to the front housing 2 reaction forces of the-pressures applied to the orbiting scroll 7 in the compression chamber P.

The orbital movement of the scroll 7 will now be described in detail. As the rotary shaft 3 rotates, the eccentric shaft 4 engages in the orbital movement about the axis $L_1$ along a circular locus with a radius r. As the orbiting scroll 7 moves around the rotary shaft 3, the refrigerant gas resultantly is introduced through an inlet port (not shown) into the compression chambers P. The compression chamber P decreases its volumes while the orbiting scroll 7 performs its orbital movement. At the same time, the chamber P is shifted toward the center portions of the spiral walls 1*b*, 7*b* of the scrolls 1, 7. This gradually compresses the refrigerant gas in the compression chamber P. The compressed gas is then discharged into the discharge chamber 12 through a discharge port 1*c* formed in the base plate 1*a*. The discharge port 1*c* is normally shut off by means of a discharge valve 13.

The orbiting scroll 7 in FIG. 2 is in a position 180 degrees opposite to the position in FIG. 3. As shown in FIG. 2, the orbiting scroll 7 is at the lowest position of its rotation. The pins $9b_1$ and $9b_2$ contact the upper positions of the inner periphery of the holes $8B_1$, $8B_2$, respectively. The ring 9 is eccentrically positioned upward with respect to the axis $L_1$. Therefore, the preventing pins $9a_1$, $9a_2$ contact the lowest portions of the inner periphery of the holes $8A_2$, $8A_2$ of the housing, respectively.

When the eccentric shaft 4 moves by 180 degrees from the position shown in FIG. 2, the orbiting scroll 7 moves to the uppermost position of its rotation shown in FIG. 3. Accordingly, the pins. $9b_1$, $9b_2$ contact the lowermost portions of the inner periphery of the holes $8B_1$, $8B_2$ of the scroll 7, respectively. As a result, the ring 9 is eccentrically positioned downward with respect to the axis $L_1$ of the rotary shaft 3. Therefore, the pins $9b_1$, $9b_2$ contact the uppermost positions of the inner periphery of the holes $8A_1$, $8A_2$, respectively.

More specifically, as the orbiting scroll 7 rotates, the pins $9b_1$, $9b_2$ slide along the inner periphery of the holes $8B_1$, $8B_2$, of the orbiting scroll 7. Accordingly, the ring 9 is shifted toward the orbit by this sliding action. Therefore, the contact portions between the pins $9a_1$, $9a_2$ and the holes $8A_1$, $8A_2$ of the housing 2 are eccentrically positioned by 180 degrees with respect to the contact portions between the pins $9b_1$, $9b_2$ and the inner peripheral surfaces of the holes $8B_1$, $8B_2$ of the orbiting scroll 7.

The orbiting scroll 7 is subject to orbitally move about the axis $L_2$. However, the pins $9a_1$, $9a_2$, $9b_1$, $9b_2$ are secured to the ring 9, and the collars 8A are secured to the front housing 2. Therefore, the pins $9a_2$, $9b_2$ in the holes $8A_1$, $8A_2$ of the housing 2 prevent the ring 9 from rotating in either direction. This preventative measure for the orbiting scroll 7 from rotating will take place at any location alone the orbit of the scroll 7. Therefore, the orbiting scroll 7 never rotates around the central axis $L_2$ of the bushing 6.

In the scroll type compressor according to this embodiment, the number of rings for restricting the locus of the orbiting scroll is reduced by one with comparison to the conventional compressor described in Japanese Examined Patent Publication No. 2-2476. Further, the elements 10 which transmits the compression reaction force independently from the holes $8A_2$, $8B_2$ and the holes $8B_1$, $8B_2$ slide on the scroll base plate 7*a* and wall 2*a*, and transmit the compression reaction force of the refrigerant gas to the wall 2*a*. The radius of each element 10 can be set as large as possible when the radius of each through hole 9*c* is enlarged within the width of the ring 9. Since a larger diameter of each element 10 increases the ability for transmitting the force, the number of the elements 10 can resultantly be reduced.

Only the pins $9a_1$, $9a_2$, $9b_1$, $9b_2$ function to prevent anti rotation of the orbiting scroll 7. Therefore, the inner periphery of the holes $8A_1$, $8A_2$, $8B_1$, $8B_2$ should be finished with high accuracy. In the compressor described in the Japanese Examined Patent Publication No. 2-2476 in which the rollers serve as means for transmitting the compression reaction force and means for regulating rotation of the orbiting scroll 7, inner peripheries of all pockets should be finished with high accuracy and precision. According to the present embodiment, the through holes 9*c* in which the elements 10 transmit the compression reaction force need not be finished with the high accuracy. Accordingly, the improved compressor reduces the number of parts used, and further the manufacturing process can be simplified and the manufacturing cost can be reduced.

According to this embodiment, since the pins $9a_1$, $9a_2$, $9b_1$, $9b_2$ are secured to the ring 9, the holes $8A_1$, $8A_2$, $8B_1$, $8B_2$ are not required to be formed in the ring 9 which has a structural limitation of the width. Therefore, the ring 9 can be made compactly, so as to achieve the down-sizing and light weight of the overall compressor.

Figure 5:
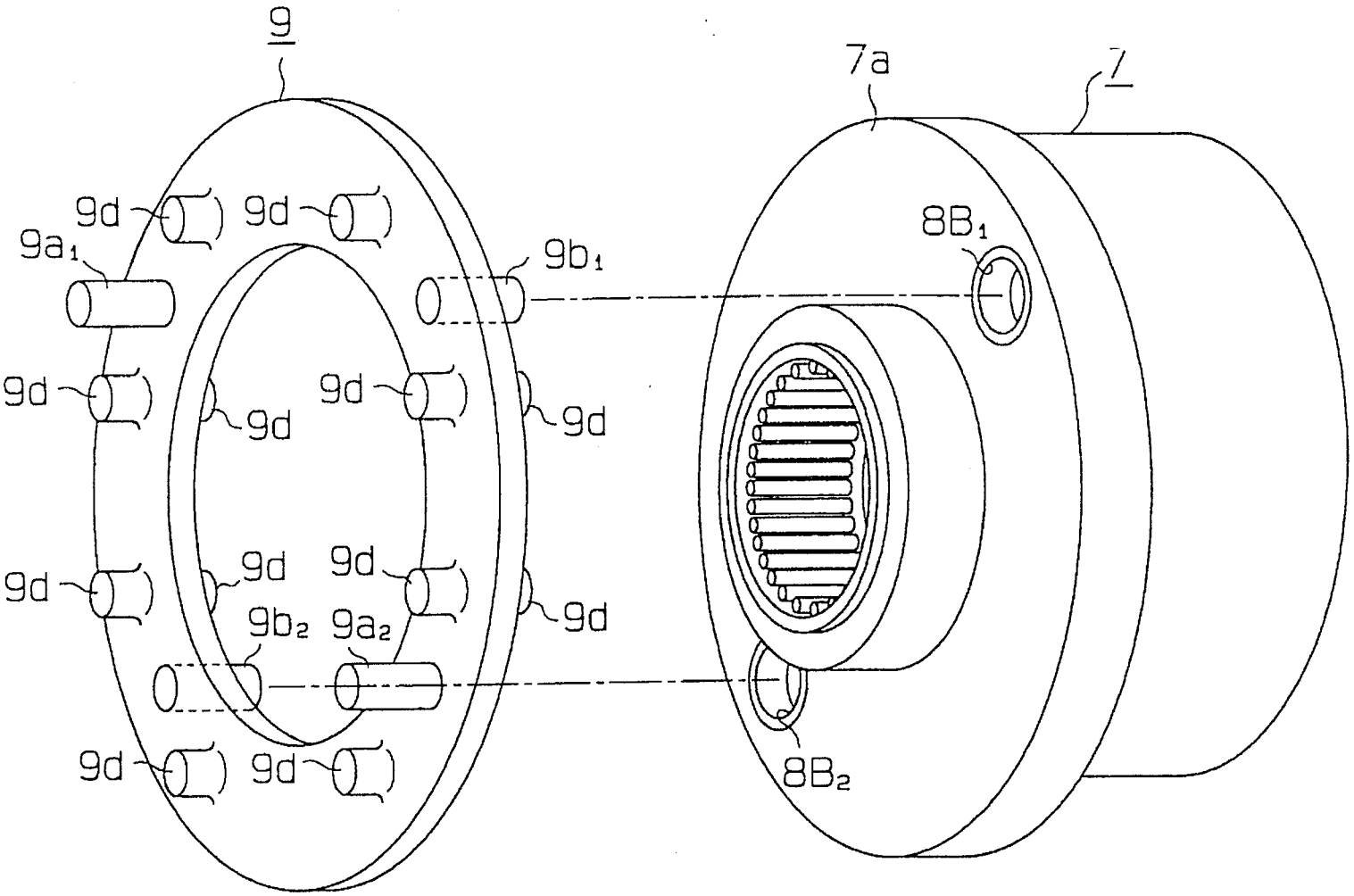
FIG. 5 is an exploded view in perspective according to a modification of the first embodiment.

According to the first embodiment, the elements 10 are loosely inserted into the through holes 9*c* in the rang 9. However, elements 9*d* can be integrally formed on both surfaces of the ring 9, as shown in FIG. 5.

Second Embodiment

The second embodiment of the present invention will now be described in greater detail, with reference to FIG. 6.

According to this embodiment, a plurality of pressure receiving elements 14 are formed around the circumference of the base plate 7*a*. The elements 14 disposed at the front and rear of the rang 9 are received by cylindrical protrusions 9*e* which extend from both side surfaces of the ring 9. The flat portions 14*b* of the elements 14, shown in FIG. 6r are disposed so that those on the front side of plate 9 are in slidable communication with the pressure receiving wall 2*a* of the front housing 2 FIG. 1. Flat portions 14*b* of the elements 14 disposed at the rear side of plate 9 are in slidable communication with the rear surface of the base plate 7*a*.

Due to production and manufacturing tolerances, it is difficult to set base plate 7*a* exactly parallel to tolerance thereof. Portions 14*a* of the elements 14 have rotational freedom and absorb the tolerance along the parallel direction. Accordingly, the elements 14 contact the wall 2*a* and the rear surface of the base plate 7*a* of the orbiting scroll 7. With such contact, it is possible to receive compression reaction forces at the wall side 2*a* of front housing 2 without accompanying reaction force strain thereby allowing for the smooth revolution of the orbiting scroll 7.

Third Embodiment

Figure 7:
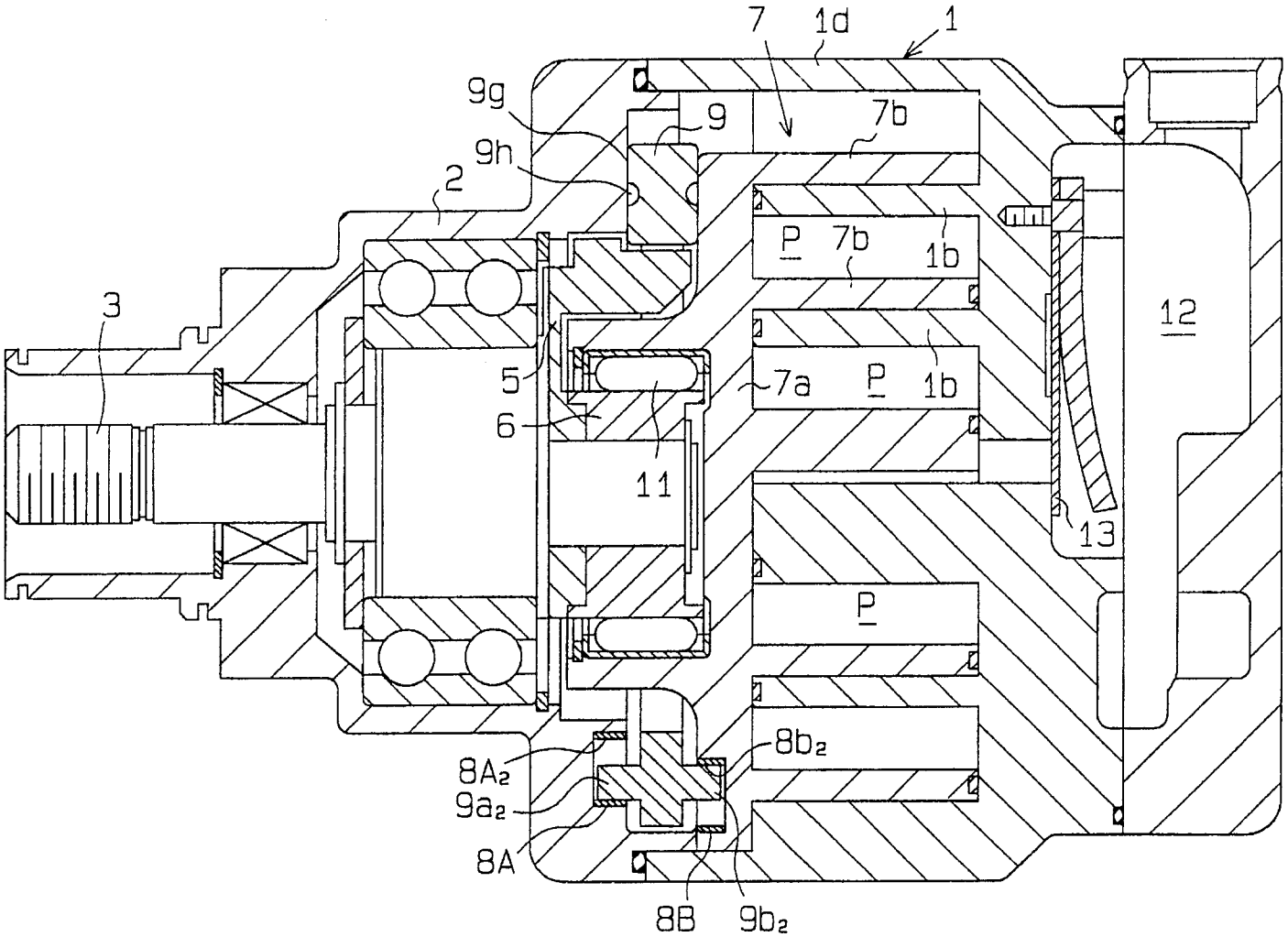
FIG. 7 is a longitudinal sectional view showing a compressor according to a third embodiment of the present invention.

The third embodiment of the present invention will now be described in greater detail, with reference to FIGS. 7 and 8. In this embodiment, the pins $9a_1$, $9b_1$, $9a_2$ and $9b_3$, integrally formed at four corresponding locations an both sides of the ring 9, are constructed to prevent the orbiting scroll 7 from rotating around its own axis. A plurality of truncated wedge shaped receiving elements 9*d* are also integrally formed on the front and rear surfaces of the ring 9. A cavity 9*h* formed in a sliding surface 9*g* allows lubrication to be applied between the ring 9 and the housing 2. Further, guiding grooves 9*i* for guiding the refrigerant gas to the pins $9a_1$, $9b_2$ are formed between the respective adjacent elements 9*d*.

In the third embodiment, due to the integral formation of the elements 9*d* with the ring 9, the number of the compressor's component parts is effectively reduced allowing for a simplified compressor structure. Moreover, according to this embodiment, only support holes 9*j* for pins $9a_1$ and $9a_2$, cavities 9*h* guiding grooves 9*i* need to be provided in the plate shaped ring 9. As a result, rang 9 can be more precisely manufactured and assembled to meet rigid to tolerance demands.

Although only three embodiments of the present invention have been described herein, it should be apparent to those skilled in the art that the present invention may be embodied in many other specific forms without departing from the spirit or scope of the invention. Particularly, it should be understood that following modes are to be applied.

Figure 8:
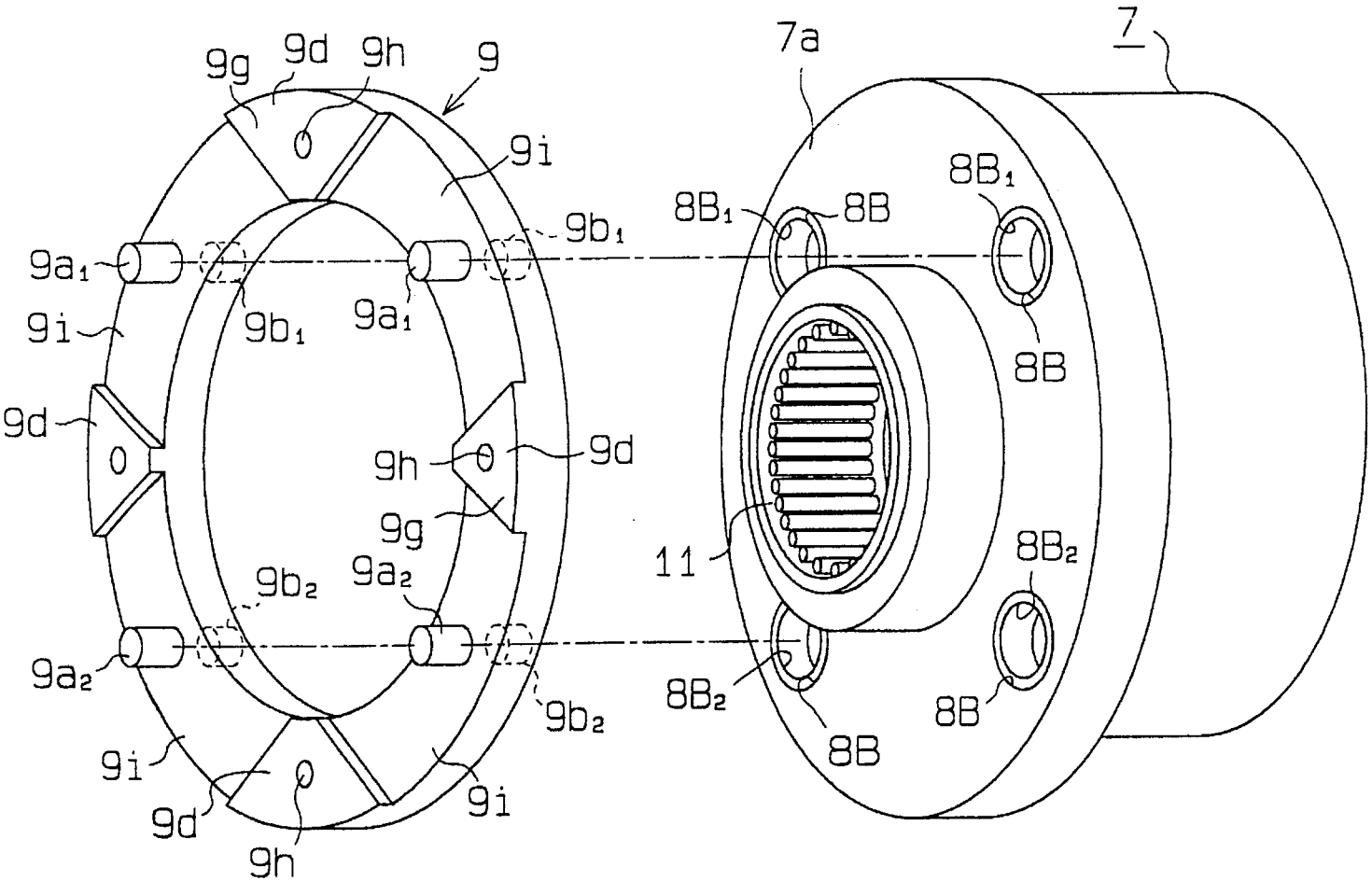
FIG. 8 is an exploded perspective view showing the ring and orbiting scroll according to the third embodiment of the present invention.

(1) Pins $9a_1$ and $9a_2$ of FIG. 8 as well as pins $9a_1$ end $9b_2$ of FIG. 1, described in the first and second embodiments, may be integrally formed with the ring 9. Using this pin construction, the number of the compressor's component parts would be reduced allowing for a more simplified manufacturing and assembling procedure.

Figure 10:
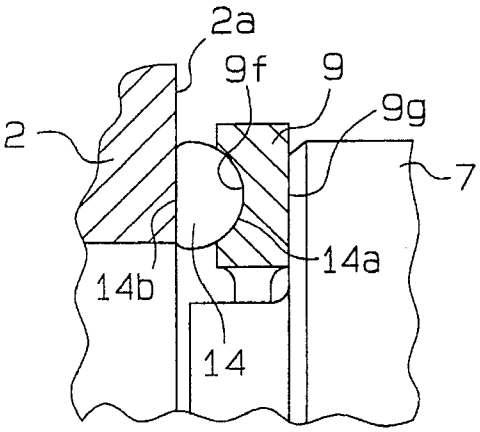
Figure 9:
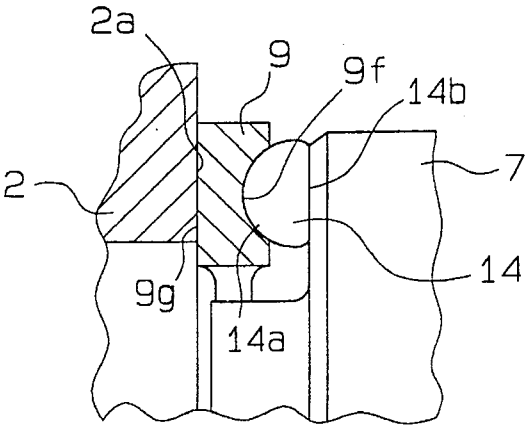
Figure 15:
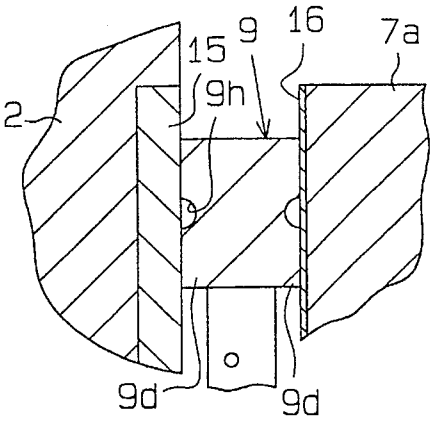

(2) As shown in FIG. 9, the spherical portion 14*a* of the element 14 is received and supported by a recess 9*f* within the ring 9, while the flat portion 14*b* slides along the wall 2*a*. The sliding surface 9*g* of the ring 9 slidably engages the rear surface of the orbiting scroll 7. Recess 9*f*, element 14, and sliding surface 9*g* may be constructed in a mirror image along a vertical axis from that shown in FIG. 9, as shown in FIG. 10.

Figure 11:
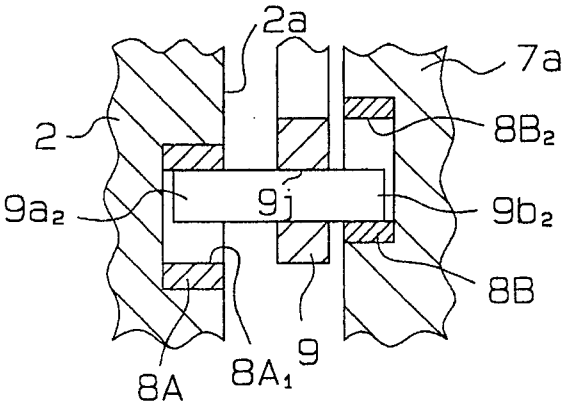
FIGS. 9 through 15 are sectional views showing various modifications to the respective embodiments of FIGS. 1–8.

(3) As shown in FIG. 11, pins $9a_2$ and $9b_2$ may be integrally formed and firmly positioned within the ring 9, also reducing the number of component parts.

Figure 12:
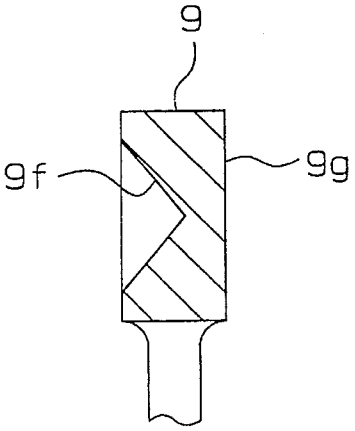
Figure 13:
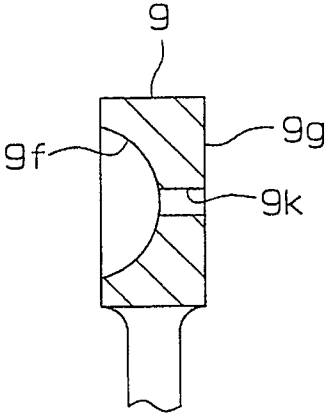
Figure 16:
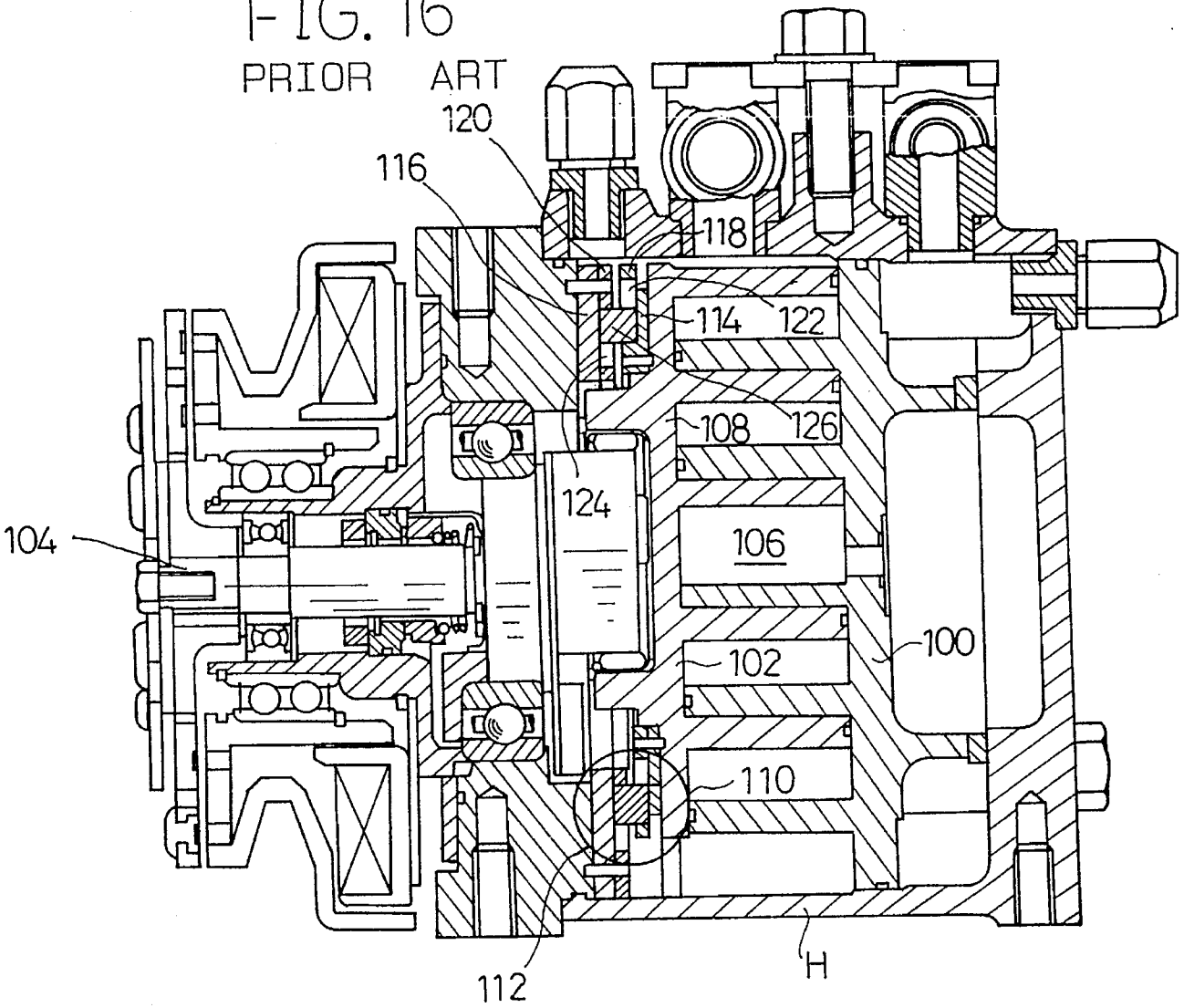
FIG. 16 PRIOR ART
FIGS. 16 and 17 are longitudinal and cross-sectional views showing a conventional compressor, respectively.
Figure 17:
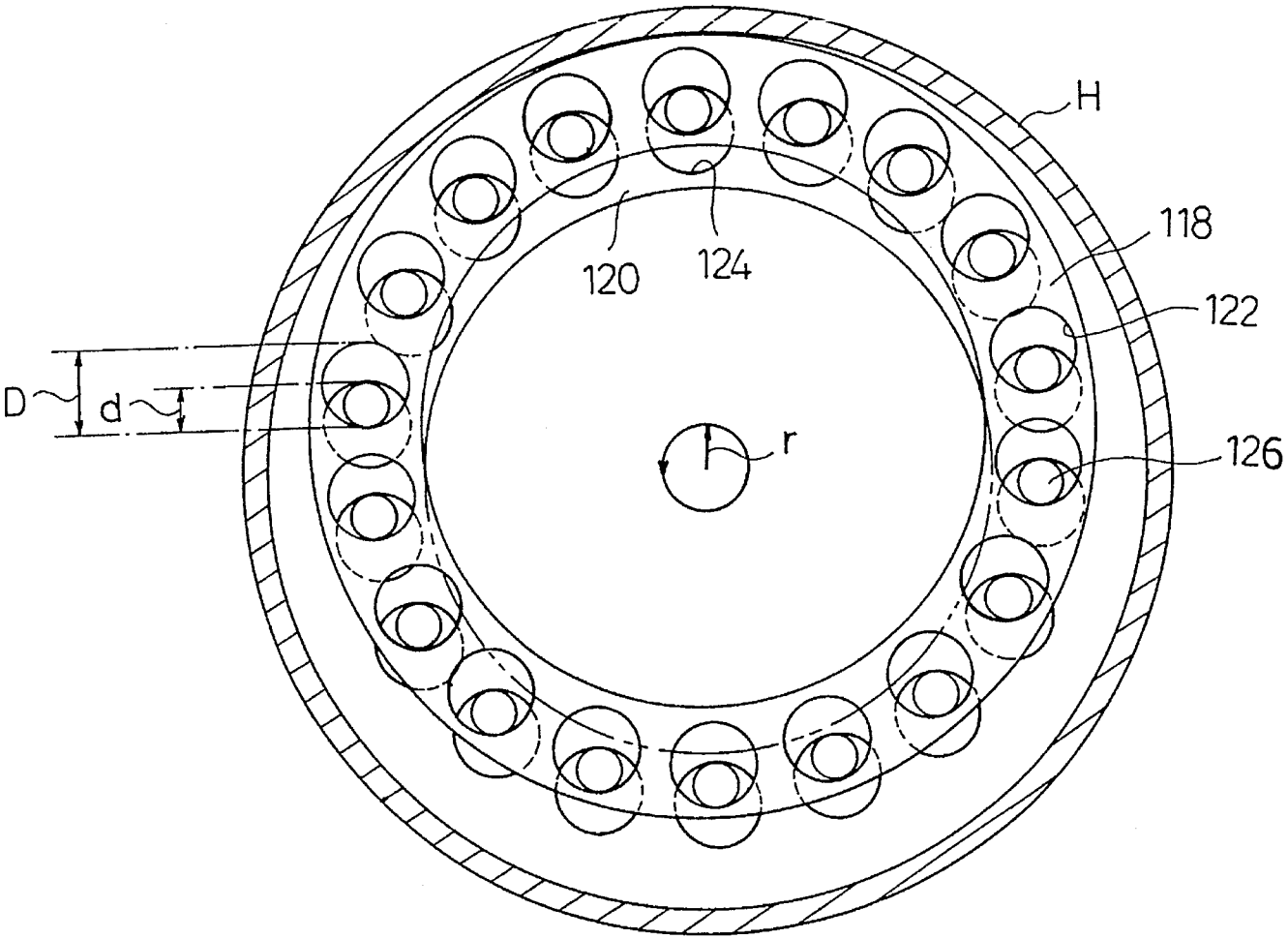
FIG. 17 PRIOR ART

(4) As shown in FIG. 12, the recess 9*f* in the ring 9 can be formed in the shape of a circular cone. As shown in FIG. 13, a hole 9*k* is formed in ring 9 for communicating the recess 9*f* with the sliding surface 9*g* thereby increasing the lubricity of the surface 9*g*.

Figure 14:
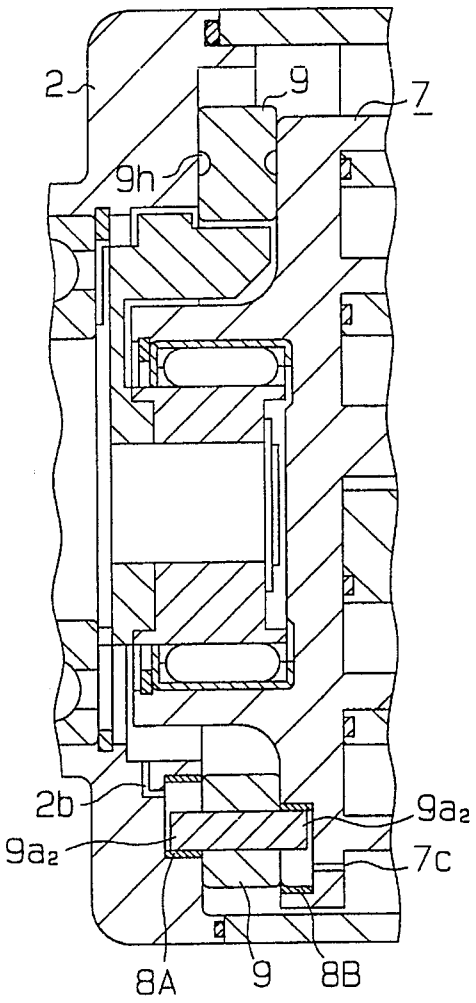

(5) As shown in FIG. 14, the ring 9 is formed using a uniformly thick ring material. Both front end rear surfaces of the ring 9 can act as sliding surfaces which slidably engage the wall 2*a* and the rear base plate surface 7*a* of the orbiting scroll 7. According to this mode, each of the sliding surfaces may be lubricated via communicating paths 2*b*, 7*c* formed in the front housing 2 and the base plate 7*a*, respectively.

(6) As shown in FIG; 15, a metal pressure receiving plate 15 is secured to the wall 2*a* of the front housing 2. A plating layer 15 consisting of nickel-phosphorus alloy or nickel-boron alloy may be formed on the rear surface of the base plate 7*a* of the scroll 7. If this mode is applied, even when the front housing 2, ring 9, and orbiting scroll 7 are formed with the same aluminum material, sliding engagement between the parts made from the same material may be avoided, allowing the weight of the ring 9 to be reduced.

(7) The collars 8A, 8B of FIG. 14 may be rotatably engaged with the wall 2*a* and base plate 7*a*, respectively. Using this mode, the revolving motion of the orbiting scroll 7 becomes more defined.

Therefore, the present examples and embodiments are to be considered as illustrative and not restrictive and the invention is not to be limited to the details given herein, but may he modified within the scope of the appended claims.

What is claimed is:

1. A scroll type compressor having a moveable scroll with an involute spiral member disposed on one side of an end plate, said moveable scroll being eccentrically connected to a rotary shaft and opposed on said one side of said end plate by a fixed scroll for forming a compression chamber therebetween, said moveable scroll being arranged to perform an orbital movement about an axis of the rotary shaft without rotating about its own axis for reducing the volume of the compression chamber and compressing coolant gas therein, said compressor further comprising:

a fixed wall adjacent said moveable scroll on the opposite side of said end plate from said spiral member for receiving an axially directed reaction force of the compressed gas acting on the moveable scroll;

a ring disposed between the moveable scroll and the fixed wall, said ring comprising a plurality of circumferentially spaced apart raised radial portions on one surface of said ring providing alternating thick and thin ring regions, said raised radial portions abutting said moveable scroll and said fixed wall for transmitting the reaction force from said fixed and moveable scrolls through said thick ring regions to said fixed wall; and means for determining the orbit of the moveable scroll, which means includes a first pair of projections extending toward the moveable scroll from said thin ring regions, a second pair of projections extending toward the fixed wall from said thin ring regions, a first pair of recesses in said moveable scroll for respectively receiving said first pair of projections for relative orbital movement, and a second pair of recesses in said fixed wall for respectively receiving said second pair of recesses for relative orbital movement.

2. A scroll type compressor having a moveable scroll with an involute spiral member disposed on one side of an end plate, said moveable scroll being eccentrically connected to a rotary shaft and opposed on said one side of said end plate by a fixed scroll for forming a compression chamber therebetween, said moveable scroll being arranged to perform an orbital movement about an axis of the rotary shaft without rotating about its own axis for reducing the volume of the compression chamber and compressing coolant gas therein, said compressor further comprising:

a fixed wall adjacent said moveable scroll on the opposite side of said end plate from said spiral member for receiving an axially directed reaction force of the compressed gas acting on the moveable scroll;

a ring disposed between the moveable scroll and the fixed wall, said ring comprising a plurality of thick portions on said ring for receiving and transmitting said reaction force from the moveable scroll to the fixed wall, each of said thick portions being separated from another thick portion by a corresponding thin portion and having cavities therein for storing lubricant to reduce friction between said thick portions and both said moveable scroll and said fixed wall; and means for determining the orbit of the moveable scroll including a first pair of projections extending toward the moveable scroll from said ring, a second pair of projections extending toward the fixed wall from said ring, a first pair of recesses in said moveable scroll for respectively receiving said first pair of projections for relative orbital movement, and a second pair of recesses in said fixed wall for respectively receiving said second pair of projections for relative orbital movement, said first and second pair of projections and said first and second pair of recesses being circular in cross-section and engaging only along peripheral surfaces thereof isolated from said axially directed reaction force; and said transmitting means being separate from said first and second pair of projections that extend from said ring.

* * * * *

UNITED STATES PATENT AND TRADEMARK OFFICE

CERTIFICATE OF CORRECTION

PATENT NO. : 5,478,223

DATED : December 26, 1995 Page 1 of 2

INVENTOR(S) : S. Yamamoto et al

It is certified that error appears in the above-indentified patent and that said Letters Patent is hereby corrected as shown below:

Column 1, line 16 after "having" delete "a"; line 57, after "performs" delete "the"; line 64 "roller" should read --rollers--.

Column 2, line 6 "numbers" should read --number--; line 60 before "9" insert --ring--.

Column 3, line 42 "Collars" should read --collars--; after "which" "as" should read --is--; line 45, "callers" should read --collars--; line 52 "pans" should read --pins--; line 62 "shorn" should read --shown--; line 66 "pane" should read "pins".

Column 4, line 1 "$9b_1$" (second occurrence) should read --$9b_2$--; line 14 "chambers" should read --chamber--; line 15 "volumes" should read --volume--; line 31 "$8A_2$," (first occurrence) should read --$8A_1$,--; line 46 after "$8B_2$" delete comma ","; line 59 "alone" should read --along--; line 67 "transmits" should read --transmit--.

UNITED STATES PATENT AND TRADEMARK OFFICE

CERTIFICATE OF CORRECTION

PATENT NO. : 5,478,223

DATED : December 26, 1995

INVENTOR(S) : S. Yamamoto et al

Figure 6:
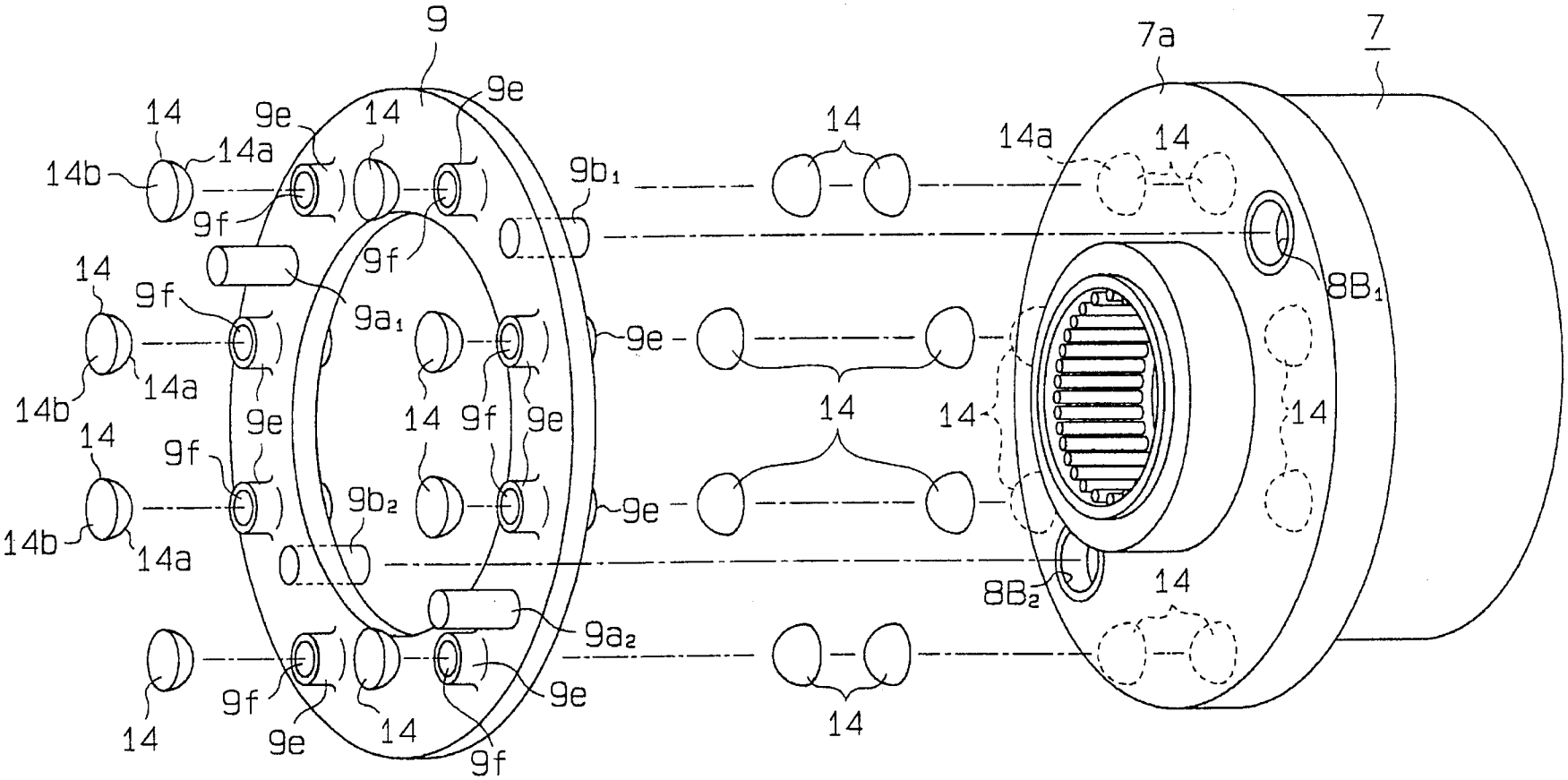
FIG. 6 is an exploded view in perspective according to a second embodiment of the present invention.

It is certified that error appears in the above-indentified patent and that said Letters Patent is hereby corrected as shown below:

Column 5, line 1 "$8A_2$, $8B_2$" should read --$8A_1$, $8A_2$--; line 7 after " transmitting" delete "the"; line 20 after "with" delete "the"; line 31 change "rang" to --ring--; line 42 change "rang" to --ring--; line 44 change "FIG. 6r" to --FIG. 6,--; line 64 change "$9b_3$" to --$9b_2$,--; line 65 "an" should read --on--.

Column 6, line 13 after "9h" insert --as well as--; line 14, "rang" should read --ring--; line 15 after "rigid" delete "to";

Signed and Sealed this

Twenty-seventh Day of August, 1996

*Attest:*

Bruce Lehman

BRUCE LEHMAN

*Attesting Officer*

*Commissioner of Patents and Trademarks*